US008047198B2

(12) United States Patent
Meyer et al.

(10) Patent No.: US 8,047,198 B2
(45) Date of Patent: Nov. 1, 2011

(54) DEVICE WITH A DOOR

(75) Inventors: Heiko Meyer, Walzbachtal (DE); Frank Wittrock, Karlsruhe (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 510 days.

(21) Appl. No.: 12/087,698

(22) PCT Filed: Jan. 10, 2007

(86) PCT No.: PCT/EP2007/050220
§ 371 (c)(1),
(2), (4) Date: Jul. 11, 2008

(87) PCT Pub. No.: WO2007/082824
PCT Pub. Date: Jul. 26, 2007

(65) Prior Publication Data

US 2009/0013986 A1 Jan. 15, 2009

(30) Foreign Application Priority Data

Jan. 18, 2006 (DE) ..... 10 2006 002 409

(51) Int. Cl.
*F23M 7/00* (2006.01)

(52) U.S. Cl. ..... 126/190; 126/194; 49/113; 49/174; 49/189

(58) Field of Classification Search ..... 126/190, 126/194; 49/113, 174, 189
See application file for complete search history.

(56) References Cited

U.S. PATENT DOCUMENTS

| | | | | | |
|---|---|---|---|---|---|
| 2,241,884 | A | * | 5/1941 | Noble | 312/323 |
| 2,257,580 | A | * | 9/1941 | Trompeter | 219/418 |
| 2,925,081 | A | * | 2/1960 | Shooter | 126/190 |
| 3,010,760 | A | * | 11/1961 | Trautmann | 296/57.1 |
| 3,127,889 | A | | 4/1964 | Mills | |
| 3,838,538 | A | * | 10/1974 | Burford | 49/258 |
| 4,219,006 | A | * | 8/1980 | Nesje | 126/192 |
| 4,516,813 | A | * | 5/1985 | Sekerich | 312/323 |
| 4,591,214 | A | * | 5/1986 | Reuter et al. | 312/110 |
| 4,615,570 | A | * | 10/1986 | Goodman | 312/110 |
| 4,726,352 | A | * | 2/1988 | Radke | 126/190 |
| 5,026,130 | A | * | 6/1991 | Wright et al. | 312/323 |
| 5,375,587 | A | * | 12/1994 | Ward et al. | 126/190 |

(Continued)

FOREIGN PATENT DOCUMENTS

DE 701 60 52 U 8/1970

(Continued)

OTHER PUBLICATIONS

International Search Report PCT/EP2007/050220.

(Continued)

*Primary Examiner* — Kenneth Rinehart
*Assistant Examiner* — Jorge Pereiro
(74) *Attorney, Agent, or Firm* — James E. Howard; Andre Pallapies

(57) ABSTRACT

A device with a door, in particular a door of a cooking appliance, supported for pivoting movement in a pivoting direction, for closing a useable space and with a guide system for at least partially lowering the door into a storage space in a guided manner, the device comprising at least one guide assembly operatively associated with the guide system and coupled to the door in a static manner in the pivoting direction and coupled to the door in a movable manner in at least one surface extension of the door.

16 Claims, 2 Drawing Sheets

U.S. PATENT DOCUMENTS

Figure 1:
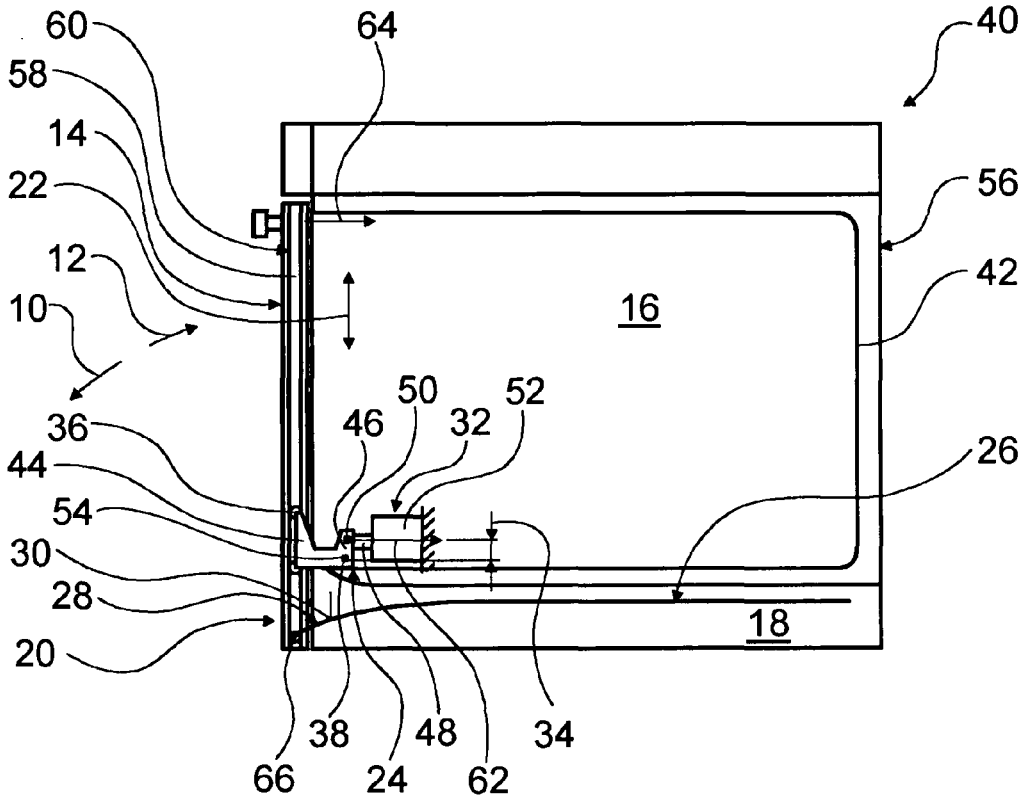

| | | | | |
|---|---|---|---|---|
| 5,657,743 | A | 8/1997 | Schwarzbaecker et al. | |
| 5,758,937 | A * | 6/1998 | Lammens et al. | 312/328 |
| 7,036,499 | B2 * | 5/2006 | Bartmann et al. | 126/191 |
| 7,064,296 | B1 * | 6/2006 | Harned et al. | 219/391 |
| 7,227,101 | B2 * | 6/2007 | Harned et al. | 219/391 |
| 7,234,457 | B2 * | 6/2007 | Bartmann et al. | 126/192 |
| 7,252,082 | B2 * | 8/2007 | Bartmann et al. | 126/191 |
| 7,255,101 | B2 * | 8/2007 | Grutzke et al. | 126/194 |
| 7,261,100 | B2 * | 8/2007 | Bartmann et al. | 126/194 |
| 7,755,004 | B2 * | 7/2010 | Collene et al. | 219/391 |
| 2001/0020811 | A1 | 9/2001 | Kawanabe | |
| 2004/0144380 | A1 | 7/2004 | Grutzke et al. | |
| 2005/0023843 | A1 * | 2/2005 | Bartmann et al. | 292/303 |
| 2005/0023945 | A1 | 2/2005 | Bartmann et al. | |
| 2005/0034381 | A1 | 2/2005 | Bartmann et al. | |
| 2006/0163981 | A1 * | 7/2006 | Conrad | 312/323 |
| 2006/0237423 | A1 * | 10/2006 | Harned et al. | 219/391 |
| 2006/0289530 | A1 * | 12/2006 | Cordae | 219/756 |
| 2007/0267401 | A1 * | 11/2007 | Collene et al. | 219/391 |
| 2007/0267402 | A1 * | 11/2007 | Harned et al. | 219/392 |

FOREIGN PATENT DOCUMENTS

| | | | |
|---|---|---|---|
| DE | 7519943 | U | 11/1975 |
| DE | 199 06 913 | | 8/2000 |
| JP | 08260808 | A * | 10/1996 |

OTHER PUBLICATIONS

Foreign Patent Office Report—WE.

* cited by examiner

DEVICE WITH A DOOR

The invention relates to a device with a door, in particular a door of a cooking appliance, according to the preamble of claim 1.

A generic device having an oven door supported so as to pivot in a pivoting direction is known from DE 199 06 913 A1. A cooking area of an oven can be closed by means of the oven door. A storage space into which the oven door can be lowered in a guided manner by means of a guide system, is arranged beneath the cooking area. The guide system has a rolling element coupled to the door, and a swivel axis fixed to the housing.

The object of the invention consists in particular in providing a generic device which advantageously facilitates increased ease of use. The object is achieved according to the invention by means of the features of claim 1, while advantageous embodiments and developments of the invention can be inferred from the subclaims.

The invention relates to a device having a door supported so as to pivot in a pivoting direction, in particular a door of a cooking appliance, by means of which a usable space can be closed, and having a guide system by means of which the door can at least partially be lowered into a storage space in a guided manner.

It is proposed that the guide system has at least one guide means which is coupled to the door in a static manner in the pivoting direction and in a movable manner in at least one surface extension of the door. An undesirable engagement and disengagement of the guide means during an operation can be avoided and an advantageous fluid, convenient transition from a swivel motion into an insertion movement and vice versa can be achieved, that is to say especially if the guide system has a guideway along which the door is guided. Furthermore, a space-saving form of construction can be achieved.

Moreover, a harmonious door movement which increases ease of operation can be achieved if the guideway has a curved guide surface in at least one area.

It is proposed in a further embodiment of the invention that the device has an energy-storage unit coupled to the door, which can further increase ease of operation, that is especially if during an opening operation the force due to weight can be used to charge up the energy storage unit, and due to the charging-up a soft, advantageously decelerated opening can be achieved, and the energy stored in the energy storage unit can be used to support a closing operation with a closing force. In this case the energy storage unit can be constructed from various storage units which appear meaningful to the expert, such as an electrical storage unit and so on, but a mechanical storage unit, in particular a spring unit, is particularly advantageous.

Preferably, the energy storage unit is coupled to the guide means, whereby an advantageous force characteristic can be achieved over the movement of the door, that is in particular if the guide means generates a lever arm for the energy storage unit. Furthermore, with a suitable design, a force which advantageously loads the door in the closing direction by means of the energy storage unit and the guide means, can be achieved.

Moreover, it is proposed that the device has at least one rolling element by means of which the guide means is coupled to the door in a movable manner, thereby enabling an advantageously low friction to be achieved.

The guide means can be guided on a track or, advantageously, can be supported about a spatially-fixed swivel axis, thereby achieving a support for said guide means which is simply constructed and economical.

Further advantages are revealed in the following description of the drawing. An exemplary embodiment of the invention is illustrated in the drawing. The drawing, description and the claims contain numerous features in combination. The person skilled in the art will also expediently examine the features individually and combine them into useful further combinations.

Figure 2:
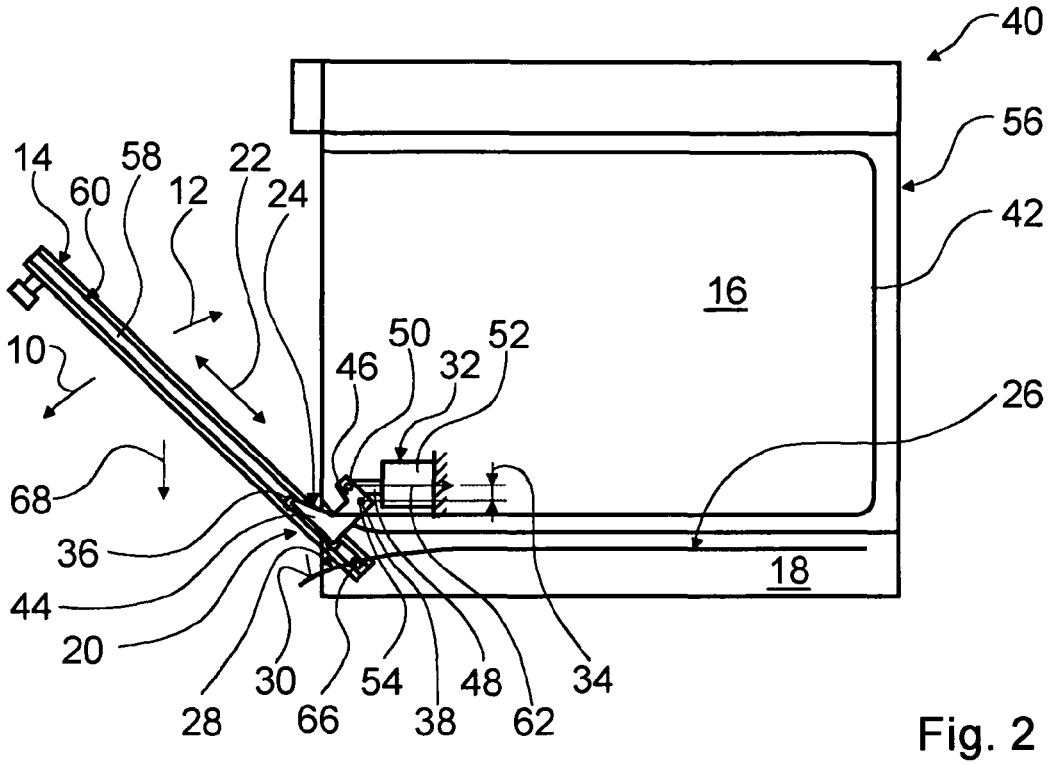
Figure 3:
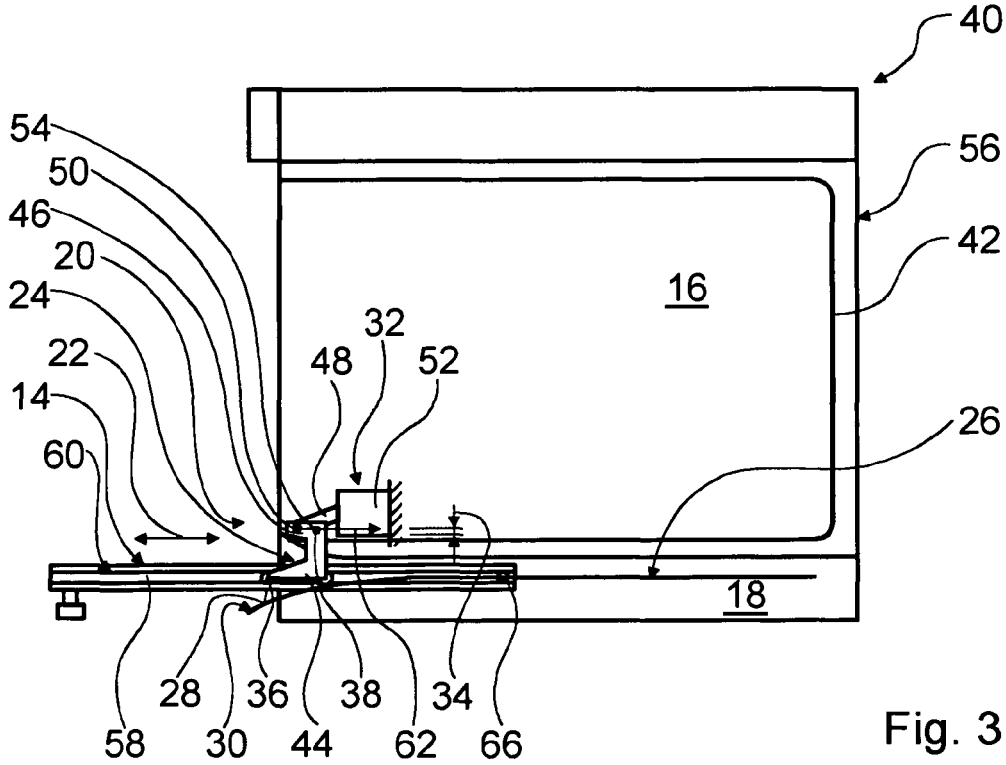

FIG. 1 shows a schematic illustration of a cooking appliance embodied as an oven with a device according to the invention, with the cooking appliance door closed, FIG. 2 shows the cooking appliance during a pivoting operation of the cooking appliance door, and FIG. 3 shows the cooking appliance during an insertion operation of the cooking appliance door.

FIG. 1 shows a cooking appliance 40 in the form of an oven, with a device which has a cooking appliance door 14 which can be supported in a pivoting manner in a pivoting direction 10, 12. The cooking appliance 40 has an oven muffle 42 arranged in a cooking appliance housing 56, said muffle enclosing a five-sided usable space 16 formed by a cooking area. The usable space 16 is closed by the cooking appliance door 14 and can be opened by means of the cooking appliance door 14 at a sixth side, that is at a front side of the cooking appliance 40. Furthermore, the cooking appliance 40 has a storage space 18 arranged under the oven muffle 42, into which storage space the cooking appliance door 14 can be lowered in a guided manner by means of a guide system 20 of the device.

The guide system 20 has two essentially corresponding guide means 24, each of which is coupled in a static manner to lateral front sides of the cooking appliance door 14 in the pivoting direction 10, 12 and in a moveable manner to a surface extension 22 of the cooking appliance door 14, only one of the two guide means 24 being shown. The guide means 24 comprises an essentially U-shaped sheet-metal part having two arms 44, 46 of differing lengths, it being possible for the longer arm 44—viewed from the side—to extend essentially in a coaxial manner to the cooking appliance door 14 and the shorter arm 46, spaced at a distance, to extend axially parallel to the cooking appliance door 14. In the area of an open, first end of the shorter arm 46, the guide means 24 has a bearing 50 in which a pin 48 of a mechanical energy storage unit 32 of the device is supported in a pivoting manner. The pin 48 of the energy storage unit 32 is coupled to a spring unit, not shown in detail, which is arranged in a housing 52 of the energy storage unit. The housing 52 of the energy storage unit is attached to the cooking appliance housing 56. The energy storage unit 32 is coupled to the cooking appliance door 14 by means of the guide means 24.

In the area of a second end of the shorter arm 46 the guide means 24 has a further bearing 54 in which the guide means 24 is supported on a bearing axle mounted in the cooking appliance housing 56, in a pivoting manner about a spatially-fixed swivel axis 38.

Furthermore, at end areas of the longer arm 44, the guide means 24 has rolling elements 36 formed by rollers and supported so as to pivot, by means of which the guide means 24 is coupled to the cooking appliance door 14 in a moveable manner. Viewed from the side, the rolling elements 36 are guided in a guide slot 58, extending in the longitudinal direction of the cooking appliance door 14, of a guide means 60 of the guide system 20, arranged in a static manner at one lateral front side of the cooking appliance door 14, so that a torque can be transmitted by the cooking appliance door 14 by means of the guide means 60 and by means of the rolling elements 36 to the guide means 24, and a torque can be transmitted from the guide means 24 to the cooking appliance door 14 (FIG. 2).

Due to the spacing of the bearing 50 and the bearing 54 in the closed state of the cooking appliance door 14, the guide means 24 forms a lever arm 34 for the energy storage unit 32, said lever arm being essentially perpendicular to a spring force 62 of the energy storage unit 32, by means of which lever arm the energy storage unit 32 acts with the spring force 62 by means of the guide means 24 on the cooking appliance door 14 and with the cooking appliance door 14 closed, generates a torque or a closing force 64 acting on the cooking appliance door 14.

Furthermore, the guide system 20 has essentially corresponding guide means 66, of which only one is shown, which are attached in the lateral front sides in the lower area of the cooking appliance door 14. The cooking appliance door 14 is guided by the guide means 66 with its lower end along a guideway 26 of the guide system 20, shown schematically, mounted in the cooking appliance housing 56. The guideway 26 extends outwards over a front side of the cooking appliance housing 56 and, starting from its front end, has over approximately one third of its length, in a front area 28, a curved guide surface 30 close to the useable space 16. Over the remainder of its length the guideway 26 runs in a rectilinear manner, parallel to a base of the useable space.

When the useable space 16 is opened by an operator, the cooking appliance door 14 is initially swung from its closed position (FIG. 1) in the pivoting direction 10. The tilting motion of the cooking appliance door 14 is transmitted to the guide means 24. The guide means 24 is tilted and the spring unit of the energy storage unit 32 is further preloaded, in particular by a force due to weight 68 of the cooking appliance door 14, so that an advantageously decelerated opening of the cooking appliance door 14 is achieved by means of the energy storage unit 32 (FIG. 2).

The cooking appliance door 14 is displaced in its surface extension 22, that is to say, viewed from the side, in the longitudinal direction of the cooking appliance door 14, relative to the guide means 24 and is guided by the guide means 66 along the guideway 26. With an increased opening position, the lever arm 34 generated by the guide means 24 is reduced to a minimum dimension by means of which the energy storage unit 32 acts on the cooking appliance door 14 by way of the guide means 24, so that in a horizontal position of the cooking appliance door 14 the energy storage unit 32 still acts on the cooking appliance door 14 with only a small torque in order to enable backlash-free guidance of the cooking appliance door 14 (FIG. 3). Alternately, however, the lever arm 34 could also be reduced to zero in the horizontal position of the cooking appliance door 14, which could avoid friction caused by the energy storage unit 32.

If during the opening operation by an operator the cooking appliance door 14 has taken up its horizontal position (FIG. 3), it can be moved in a translatory manner into the storage space 18 by means of the guide system 20, it being possible for the energy stored in the energy storage unit 32 due to the tilting motion of the cooking appliance door 14 and of the guide means 24, to remain essentially constant.

When the useable space 16 is closed by means of the cooking appliance door 14, this is withdrawn by the operator out of the storage space 18 and then again tilted into its closed position in the pivoting direction 12. In this case the energy storage unit 32 supports the closing process whereby, with the stored energy via the guide means 24, it acts on the cooking appliance door 14 with a torque which is applied in the closing direction or in the pivoting direction 12.

REFERENCE NUMBERS

10 Pivoting direction
12 Pivoting direction
14 Door
16 Useable space
18 Storage space
20 Guide system
22 Surface extension
24 Guide means
26 Guideway
28 Area
30 Guide surface
32 Energy storage unit
34 Lever arm
36 Rolling element
38 Swivel axis
40 Cooking appliance
42 Oven muffle
44 Arm
46 Arm
48 Pin
50 Bearing
52 Housing of energy storage unit
54 Bearing
56 Cooking appliance housing
58 Guide slot
60 Guide means
62 Spring force
64 Closing force
66 Guide means
68 Force due to weight

The invention claimed is:

1. A domestic appliance including a device; the device comprising:

a door supported on a body of the domestic appliance for a pivoting movement relative to the body of the domestic appliance in a pivoting direction, and for closing a useable space of the domestic appliance;

a guide system for at least partially lowering the door into a storage space in a guided manner;

at least one guide assembly operatively associated with the guide system; and a mounting unit mounting the guide assembly to the door in a static manner in the pivoting direction and in a movable manner in at least one surface extension direction of the door; and an energy storage unit coupled to the door, wherein the guide assembly is swiveled by a same angle as the door during the pivoting movement, the energy storage unit is coupled to the guide assembly, and the guide-assembly forms a lever arm for the energy storage unit and wherein an acting lever arm length of the lever arm gradually decreases while the door is opened.

2. A device comprising:

a door supported for a pivoting movement in a pivoting direction and for closing a useable space;

a guide system for at least partially lowering the door into a storage space in a guided manner;

at least one guide assembly operatively associated with the guide system;

a mounting unit mounting the guide assembly to the door in a static manner in the pivoting direction and in a movable manner in at least one surface extension direction of the door; and an energy storage unit coupled to the door, wherein the guide assembly is swiveled by a same angle as the door during the pivoting movement, the energy storage unit is coupled to the guide assembly, and the guide-assembly forms a lever arm for the energy storage unit and wherein an acting lever arm length of the lever arm gradually decreases while the door is opened.

3. The device according to claim 2, wherein the guide system includes a guideway along which the door is guided.

4. The device according to claim 3, wherein the guideway includes a curved guide surface in at least one area.

5. The device according to claim 2, further comprising at least one rolling element for coupling the guide assembly to the door in a moveable manner.

6. The device according to claim 5, further comprising another rolling element wherein two of the rolling elements run within a single guide slot located laterally at the door.

7. The device according to claim 6, wherein the guide assembly includes an arm, and the arm of the guide assembly is connected to the two rolling elements.

8. The device according to claim 2, wherein the guide assembly is supported about a spatially-fixed swivel axis.

9. The device according to claim 8, wherein the swivel axis is spaced apart from the closed door in a direction of the useable space.

10. The device according to claim 8, wherein the guide assembly features a bearing for the energy storage unit which is spaced apart from the swivel axis in a direction parallel to the surface extension direction of the door.

11. The device according to claim 2, wherein the mounting unit is provided for transmitting a torque from the door to the guide assembly and from the guide assembly to the door.

12. The device according to claim 2, wherein the guide assembly features a bearing for the energy storage unit which is spaced apart from a spatially-fixed swivel axis in a direction parallel to the surface extension of the door.

13. The device according to claim 2, wherein the guide assembly includes two arms and a connecting bar.

14. The device according to claim 13, wherein one arm of the guide assembly is connected to the two rolling elements.

15. A domestic appliance having a useable space; comprising:

a body having a storage space;

a door supported on the body for a pivoting movement relative to the body in a pivoting direction, and for closing the useable space of the domestic appliance;

a guide system for at least partially lowering the door into the storage space in a guided manner;

at least one guide assembly operatively associated with the guide system; and a mounting unit mounting the guide assembly to the door such that the guide assembly is pivotably fixed relative to the door, and such that the guide assembly is movable relative to the door in a direction parallel to a longitudinal direction of the door, wherein the guide assembly is U-shaped and has a first arm and a second arm, the appliance further comprising a rolling element attached to the first arm and being slidably connected to the door;

a pivoting connection attached to the guide assembly and being translationally fixed relative to the body of the domestic appliance; and a mechanical energy storage unit attached to the second arm.

16. A domestic appliance having a useable space; comprising:

a body having a storage space;

a door supported on the body for a pivoting movement relative to the body in a pivoting direction, and for closing the useable space of the domestic appliance;

a guide system for at least partially lowering the door into the storage space in a guided manner;

at least one guide assembly operatively associated with the guide system;

a mounting unit mounting the guide assembly to the door such that the guide assembly is pivotably fixed relative to the door, and such that the guide assembly is movable relative to the door in a direction parallel to a longitudinal direction of the door;

a mechanical energy storage unit attached to the guide assembly at a first point;

a rolling element attached to the guide assembly, the rolling element having at least two rollers spaced apart from one another along a first line, the rolling element being slidably connected to the door; and a pivoting connection attached to the guide assembly and being translationally fixed relative to the body of the domestic appliance, the guide assembly pivoting around the pivoting connection at a pivot point that is translationally fixed relative to the body of the domestic appliance, wherein the first point and the pivot point are offset from one another along a second line, and the second line is substantially parallel to the first line.

* * * * *